US005506931A

United States Patent [19]

Leon

[11] Patent Number: 5,506,931

[45] Date of Patent: Apr. 9, 1996

[54] IMMERSION TYPE WATER HEATING ELEMENT ASSEMBLY WITH PERMANENTLY WIRED ELECTRICAL SUPPLY

[75] Inventor: George S. Leon, Trujillo Alto, Puerto Rico

[73] Assignee: The Commonwealth of Puerto Rico, San Juan, Puerto Rico

[21] Appl. No.: 207,707

[22] Filed: Mar. 9, 1994

[51] Int. Cl.[6] ..... F24H 1/20; F24H 9/06; H05B 3/12

[52] U.S. Cl. ..... 392/501; 392/441; 392/451; 392/497; 219/523; 219/536

[58] Field of Search ..... 392/441, 449, 392/451, 455, 497, 501, 485, 486, 487; 439/266, 267; 219/523, 536, 537, 738, 439

[56] References Cited

U.S. PATENT DOCUMENTS

| | | | |
|---|---|---|---|
| 2,418,520 | 4/1947 | Morton . | |
| 2,594,255 | 4/1952 | Charbonneau . | |
| 2,613,312 | 10/1952 | Thurston | 219/38 |
| 2,772,343 | 11/1956 | Buehne . | |
| 3,111,572 | 11/1963 | Drugmand | 219/38 |
| 3,202,795 | 8/1965 | Kreiser . | |
| 3,202,796 | 8/1965 | Drugmand | 219/318 |
| 3,210,526 | 10/1965 | Burger | 219/318 |
| 3,228,796 | 10/1965 | Drugmand . | |
| 3,778,592 | 12/1973 | Williams | 219/336 |
| 3,916,149 | 10/1975 | Skinner . | |
| 3,977,073 | 8/1976 | Shirey . | |
| 4,178,497 | 12/1979 | Cunningham . | |
| 4,430,556 | 2/1984 | Inskip et al. . | |
| 5,252,303 | 10/1993 | Goof | 422/292 |

FOREIGN PATENT DOCUMENTS 461710 2/1937 United Kingdom .

*Primary Examiner*—Bruce A. Reynolds
*Assistant Examiner*—Sam Paik
*Attorney, Agent, or Firm*—Oblon, Spivak, McClelland, Maier & Neustadt

[57] ABSTRACT

An immersion type water heating element assembly. The assembly allows replacement of a water heating element for a hot water tank without removing the electrical supply wires or disconnecting an electrical supply by providing a first main plate having a hole therethrough and permanently attached to a hot water tank. Supply terminals are positioned on the first main plate and permanently wired to an electrical supply for supplying current. A second plate is detachably mounted to the first main plate and includes a water heating element and contact terminals which contact the electrical supply terminals when the second main plate is mounted on the first main plate. The assembly includes a sealing device for preventing water in the hot water tank from leaking through the first main plate and the second main plate. The immersion type heating element attached to the second main plate extends through the hole in the first main plate and into the hot water tank. A conducting device connects the contact terminals to the heating element. An electrical resistor within the heating element is connected to the power contact terminals through the conducting device when the second main plate is mounted on the first main plate. Therefore, the water heating element may be removed by simply detaching the second main plate without having to remove electrical supply wires or disconnecting an electrical supply.

13 Claims, 7 Drawing Sheets

IMMERSION TYPE WATER HEATING ELEMENT ASSEMBLY WITH PERMANENTLY WIRED ELECTRICAL SUPPLY

BACKGROUND OF THE INVENTION

1. Field of the Invention

This invention relates to a water heating element and, more particularly, to an immersion type water heating element assembly.

2. Description of the Related Art

Immersion type water heaters are used to heat water in hot water tanks by connecting a water heating element to an electrical supply and inserting the element into the hot water tank. The heating element is usually inserted into a hole in a side of the hot water tank. The heating element is water sealed within the tank to prevent leakage. In practice, heating elements tend to require replacement several times during the life of a hot water tank. Therefore, there arises a need for an immersion type water heating element that is water tight and easily replaced.

The electrical supply to the water heating element poses a particular problem in replacing the water heating element. Normally, a repair person must turn off the main electrical supply and then remove the electrical supply wires from the heating element, which are exposed on the outside surface of the hot water tank. The heating element is then replaced, the wires are reconnected and the electrical supply is turned back on. Because the electrical supply must be disconnected, the repair person is in danger of electrical shock. In particular, when the repair person is not familiar with the electrical supply, such as a fuse box located in a residence, the correct electrical supply line may not be turned off. Further, disconnecting the electrical supply is time consuming.

Therefore, an immersion type water heating element which is easily detached from a hot water tank without having to remove the electrical supply wires is needed. Heretofore, the related art does not provide such a device.

U.S. Pat. No. 2,594,255, issued to Charbonneau, discloses a typical heating element which extends into a hot water tank. FIG. 2 clearly shows that the electrical supply wires are connected to terminals 15. Clearly, the electrical wires must be disconnected from the terminals when replacing the heating element 10.

SUMMARY OF THE INVENTION

Accordingly, an object of the present invention is to provide for an immersion type water heating element assembly with a heating element which is easily detached from the hot water tank.

Another object of the present invention is to provide an immersion type heating element assembly which allows a repair person to replace the heating element safely and free from danger of shock.

A further object of the present invention is to provide an immersion type water heating element assembly having an easily replaceable heating element and a water tight seal.

A further object of the present invention is to provide an immersion type water heating element assembly having a water heating element which may be removed without having to disconnect electrical supply wires.

An immersion type water heating element assembly of the present invention includes a first main plate having a hole therethrough and attachable to a hot water tank. Supply terminals are positioned on the first main plate and permanently wired to an electrical supply for supplying electrical current to a heating element. A second main plate is detachably mounted to the first main plate and has contact terminals which contact the electrical supply terminals when the second main plate is mounted on the first main plate. Sealing means prevents water from leaking out of the hot water tank through the first and second main plates. An immersion type heating element is attached to the second main plate such that, when the second main plate is mounted on the first main plate, the heating element extends into the hot water tank through the hole in the first main plate. When the second main plate is removed from the first main plate, the electrical supply does not have to be disconnected from the electrical supply terminals. Conducting means are associated with the second main plate for electrically connecting the contact terminals on the second main plate to the heating element. The heating element contains an electrical resistor connected to the contact terminals such that, when the second main plate is mounted on the first main plate, electric current flows from the electrical supply terminals to the contact terminals and through the conducting means to the electrical resistor. Thus, the water in the hot water tank is heated, the water is sealed within the hot water tank and the electrical supply does not have to be detached from the heating element when the heating element is replaced.

The present invention, therefore, fulfills all of the objectives of an immersion type water heating element assembly. The invention provides that the electrical supply terminals are permanently wired to the first main plate, which is permanently mounted on the hot water tank. The heating element is mounted on a second plate, which is attachable to the first main plate. The second main plate has contact terminals which contact supply terminals on the first main plate which supply electrical current from the electrical supply. Therefore, a repair person need only remove the second main plate to replace the heating element and is not placed in unnecessary danger. Further, this invention allows a repair person to quickly replace the heating element without having to go through the time consuming process of figuring out which electrical supply line needs to be turned off and without having to disconnect electrical wires.

BRIEF DESCRIPTION OF THE DRAWINGS

A more complete appreciation of the invention and many of its attendant advantages will be readily obtained by reference to the following detailed description considered in connection with the accompanying drawings, in which.

DETAILED DESCRIPTION OF THE PREFERRED EMBODIMENTS

Figure 1B:
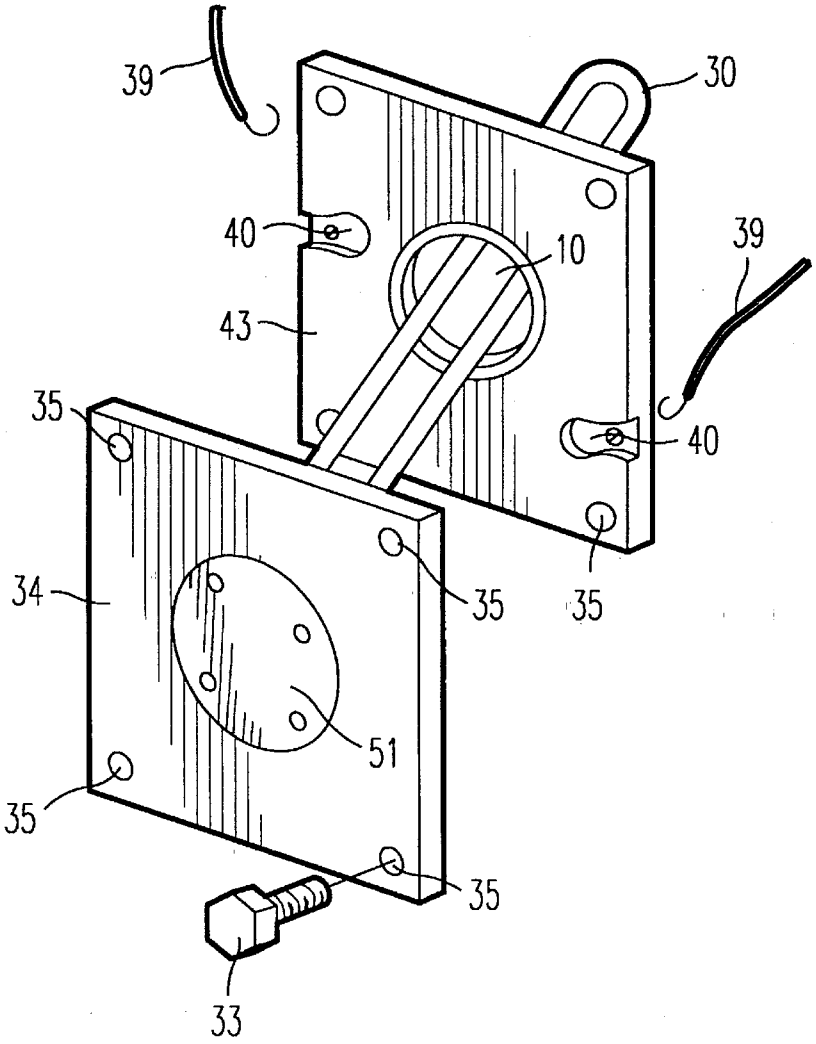
FIG. 1B shows the heating element on the second plate being inserted through the permanent plate, attached to a hot water tank.

Referring now to the drawings, wherein like reference numerals designate identical or corresponding parts through the several views, the invention is described below with reference to the figures.

Figure 1A:
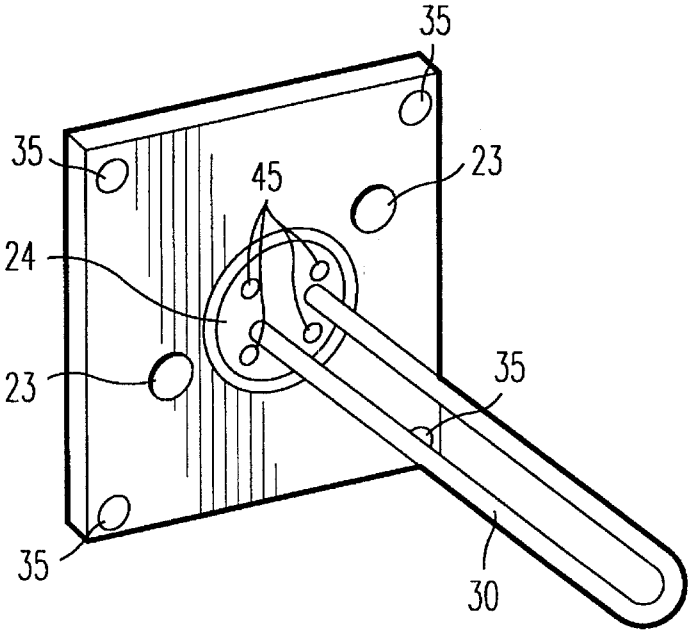
FIG. 1A shows the heating element attached to the second plate.

FIG. 1A shows a heating element 30 attached to a second plate 34. The heating element 30 is removably attached to the second plate 34 by a base plate 24 held to the second plate 34 by screws 45. The heating element 30 extends away from the second plate 34, substantially perpendicular to the plane of the second plate 34. Contact terminals 23 supply electricity for heating the heating element 30.

FIG. 1B shows the second plate 34 being mounted on the first plate 43. As shown, the heating element 30 extends through a hole 70 in the first plate 43. The first plate 43 is attached to a hot water tank (not shown).

The first plate 43 includes supply terminals 40 for supplying electricity from wires 39. An electrical supply (not shown) is connected to the supply terminals 40 through the wires 39. The first plate 43 also includes bolt holes 35 for receiving bolts 33, which fixes the second plate 34 to the first plate 43. To remove the second plate 34 and the heating element 30, a repair person needs only to remove the second plate 34 by loosening the bolts 33. Neither the supply wires 39 nor the electrical supply (not shown) need to be disconnected.

Figure 2A:
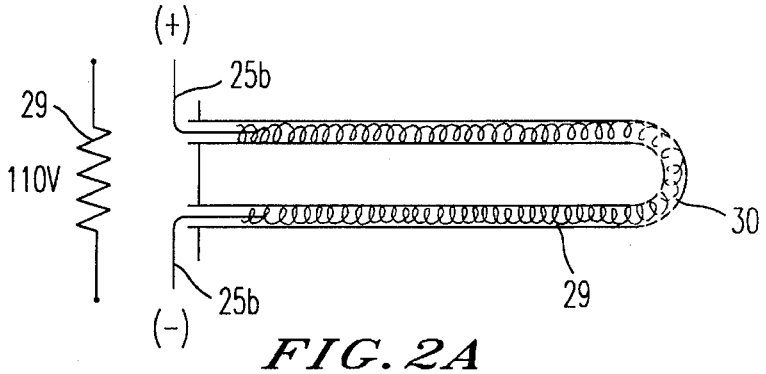
FIG. 2A shows a resistor inside the heating element and the voltage across this resistor.

FIG. 2A shows the electrical resistor 29 inside the heating element 30. Preferably, a 110 v resistor 29 is used. Conducting means made up of inner connection lines 25*b* connect the resistor 29 to the contact terminals 23.

Figure 2B:
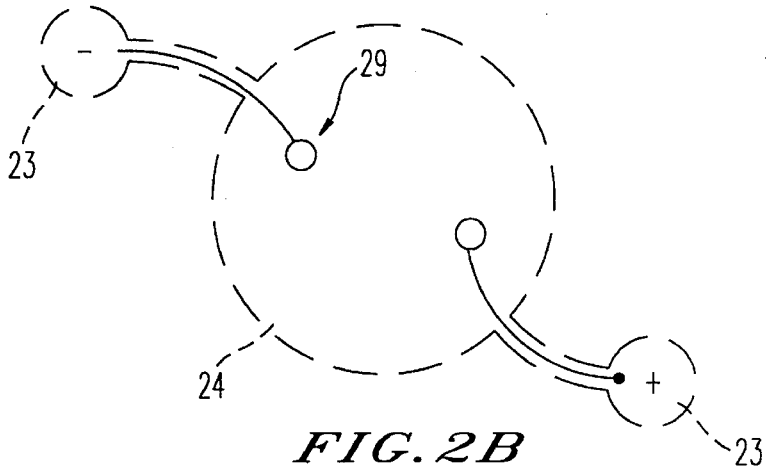
FIG. 2B is a bottom view of the second plate showing the connections between the heating element resistor and contact terminals.

FIG. 2B shows a bottom view of the second plate 34 with the contact terminals 23 connected to the resistor 29. The connections to the resistor 29 are embedded in the second plate 34, thereby protecting a repair person from electric shock when handling the second plate 34.

Figure 3A:
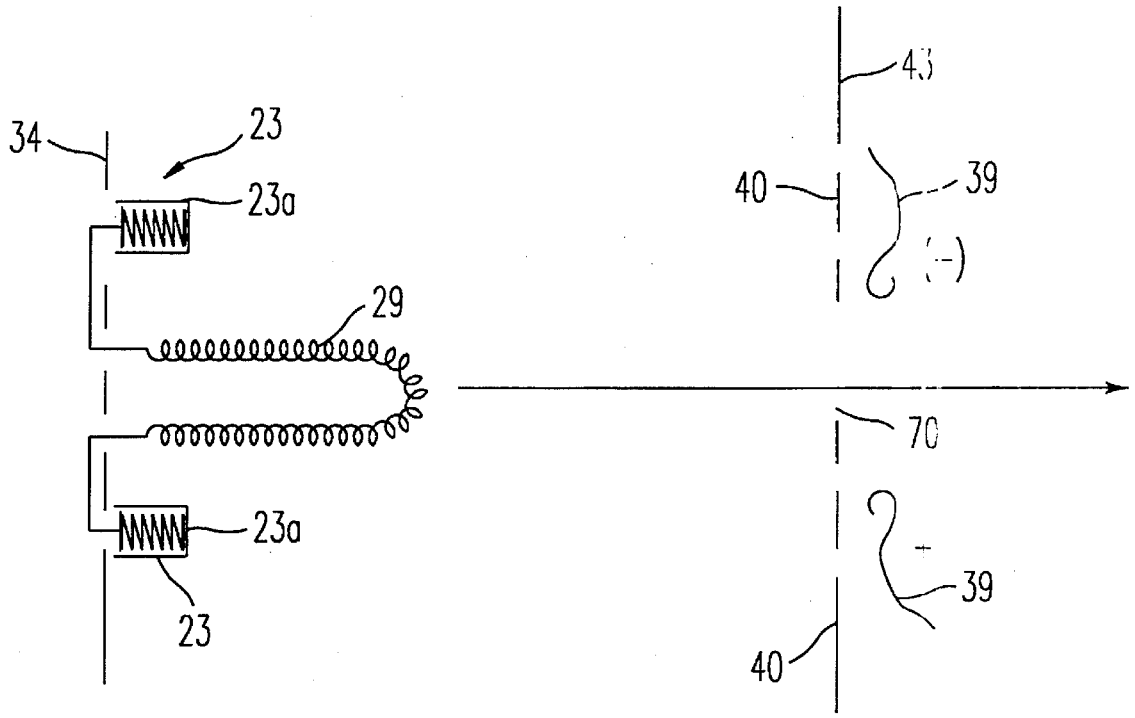
FIG. 3A is a plan view showing the electrical connections between the supply terminals on the first plate and the contact terminals or caps on the second plate.

FIG. 3A shows a wiring diagram of the first and second plates 43 and 34, respectively. As shown, the electrical resistor 29 is inserted through a hole 70 in the first plate 43 and into the hot water tank (not shown). The contact terminals 23 are aligned such that, when the resistor 29 is inserted through the hole 70 in the first plate 43, the contact terminals 23 contact the supply terminals 40. Electricity flows from the electrical supply (not shown), through the wires 39, to the supply terminals 40, through the contact terminals 23 and to the electrical resistor 29.

Figure 3B:
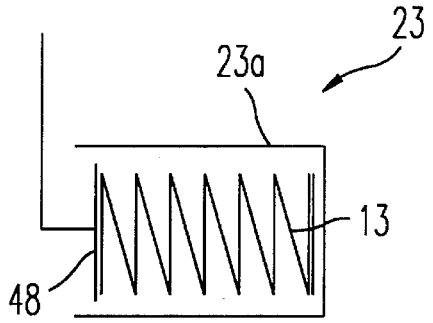
FIG. 3B is an enlarged view of a contact terminal on the second plate.

FIG. 3B shows an enlarged view of a contact terminal 23. The contact terminal includes a cap 23*a*, a spring 13 and a base 48, which are all electrically conductive. The cap, spring and base (23*a*, 13 and 48) are electrically connected such that when the cap 23*a* touches the supply terminal 40, electricity flows from the supply terminals 40, through the cap 23*a*, spring 13 and base 48 and to the resistor 29. Preferably, the cap 23*a*, spring 13 and base 48 are all spot welded to maintain good electrical contact between these elements.

Figure 4:
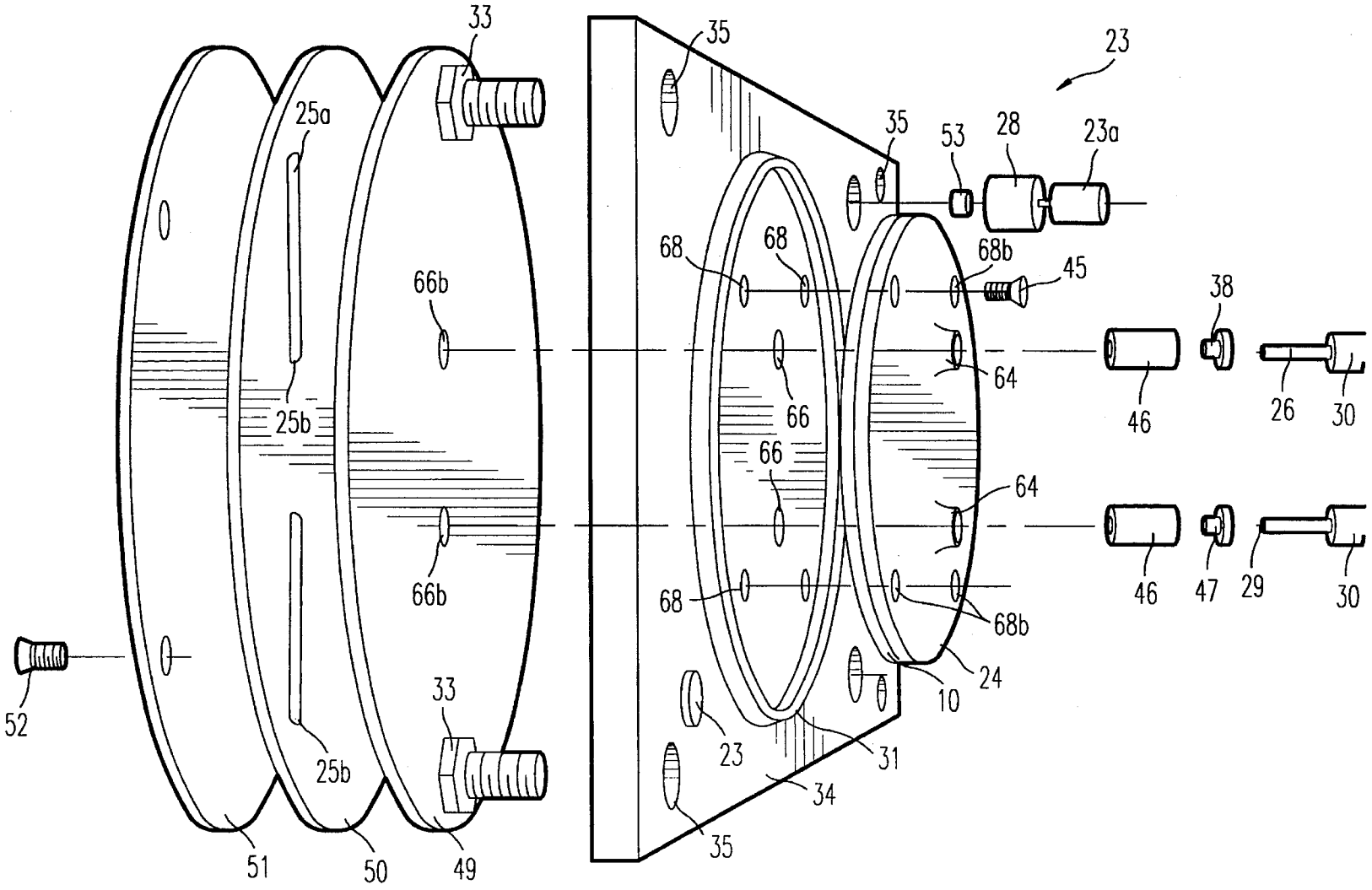
FIG. 4 is an exploded view of the second plate.

FIG. 4 shows an exploded view of the second plate 34. The second plate 34 includes a ring-like protrusion 31 on the side that the heating element 30 is inserted into the hot water tank (not shown). Within the ring-like protrusion 31 are access holes 66 for allowing connection between an electrical supply (not shown) and the electrical resistor 29. A circular base mounting plate 24 and a water resistant seal 10 are tightly fitted within the ring-like protrusion 31. The base mounting plate 24 has screw holes 68*b* for receiving screws 45 and are aligned such that they are flush with holes 68 in the second plate 34. The screws 45 are screwed into the holes 68*b* and 68 and tighten the water resistant seal 10 and base mounting plate 24 to the second plate 34. The base mounting plate 24 includes protruding supports 64 which support the heating element 30. The second plate 34 also includes the contact terminals having a cap 23*a*, a cap holding shell 28 and base 48, a spring 13 and a non-conductive material 53. The cap contacts the supply terminals 40 on the first plate 43 and transfer electricity through the spring 13, to the base 48 and to interconnection lines 25*b*. The interconnection lines 25*b* transfer electricity to the resistor 29 in the heating element 30. The non-conductive material 53 electrically insulates the contact terminals 23 from the second plate 34.

The heating element 30 is assembled onto the base mounting plate 24. Sleeves 46 are inserted into protruding supports 64. Insulator caps 47 and 38 are inserted into the sleeves 46. Terminal pins 26 are inserted into the insulator caps 47 and extend through the second plate 34 via holes 66. The terminal pins 26 are connected to the resistor 29 within the heating element 30.

A first insulator plate 49 is placed on the second plate 34 opposite the side of the heating element 30. The first insulator plate 49 completely covers the area in which the ring-like protrusion 31 is positioned. The first insulator plate 49 contains access holes 66*b* which allow the terminal pins 26 to extend through the first insulator plates 49 to contact the cap-welding point 25*a* on a second insulator plate 50. The second insulator plate 50 covers the first insulator plate 49 such that the cap welding point 25*a* contacts a terminal pin 26. The second insulator plate 50 is also water and electrical resistant. The second insulator plate 50 also includes inter-connection lines 25*b*, which connect the terminal pins 26 to the cap 23*a*, thereby completing an electrical path.

Finally, a metal plate cover 51 is tightly screwed onto the first insulator plate 49 and second insulator plate 50 by screws 52, thereby completing the second plate 34.

Figure 5:
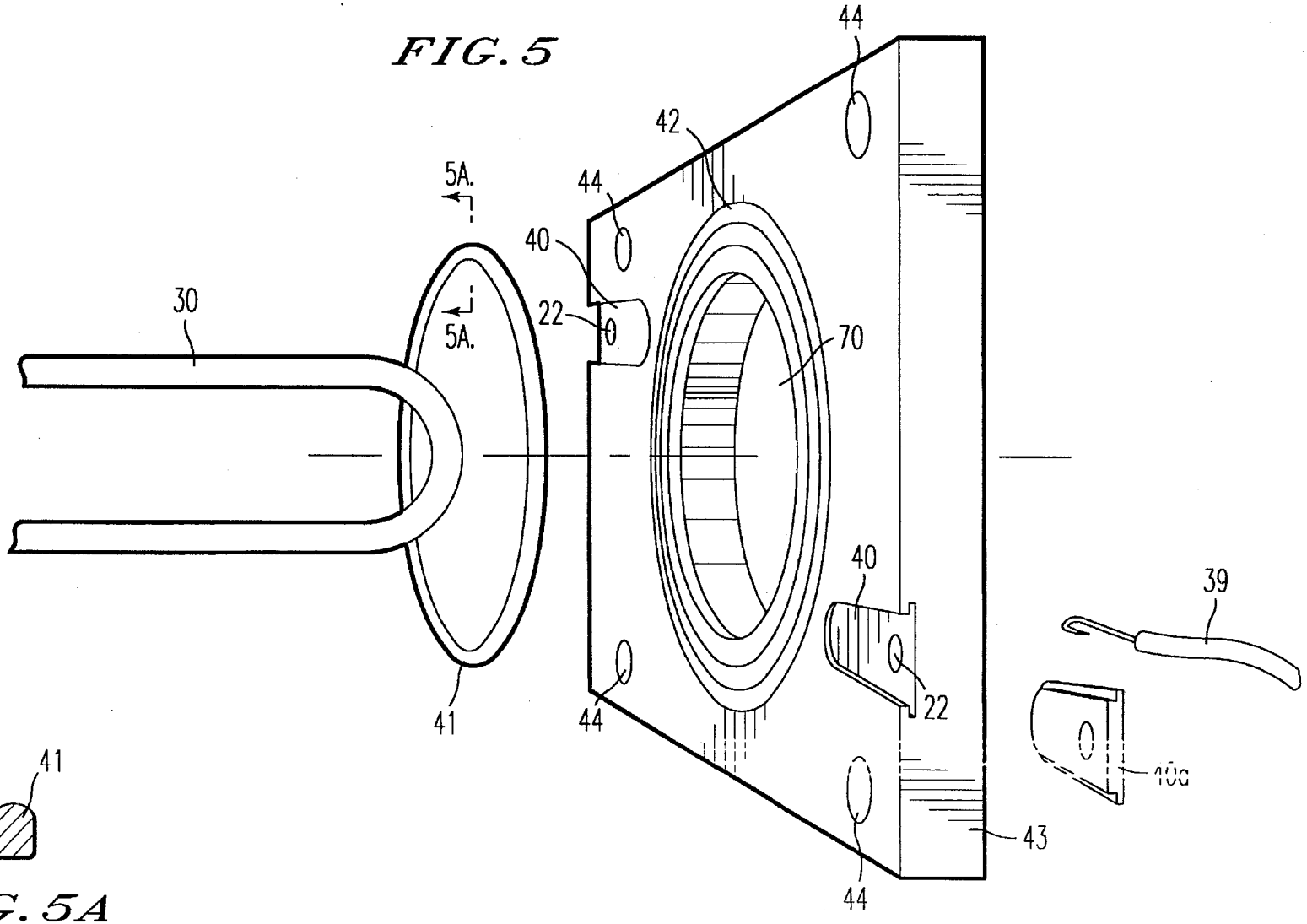
FIGS. 5 and 5A show the first plate having a ring-like groove for receiving a rubber gasket and showing the contact between the supply terminals and electrical supply wires.
Figure 5A:
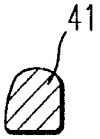

FIG. 5 shows the first plate 43 which is to be permanently mounted onto the side of a hot water tank (not shown) with bolts (not shown) bolted through holes 44. A rubber gasket 41 is shown (also in FIG. 5A) to be fitted into a ring-like hole or cavity 42 in the first plate 43. The first plate 43 includes electrical supply terminals 40 including a screw 22 and a contact plate 40. A wire 39 from an electrical supply (not shown) is connected to the screw 22 and is covered by the contact plate 40. The screw is screwed down tightly and the wire is held between the contact plate 40 and the first plate 43.

Figure 6:
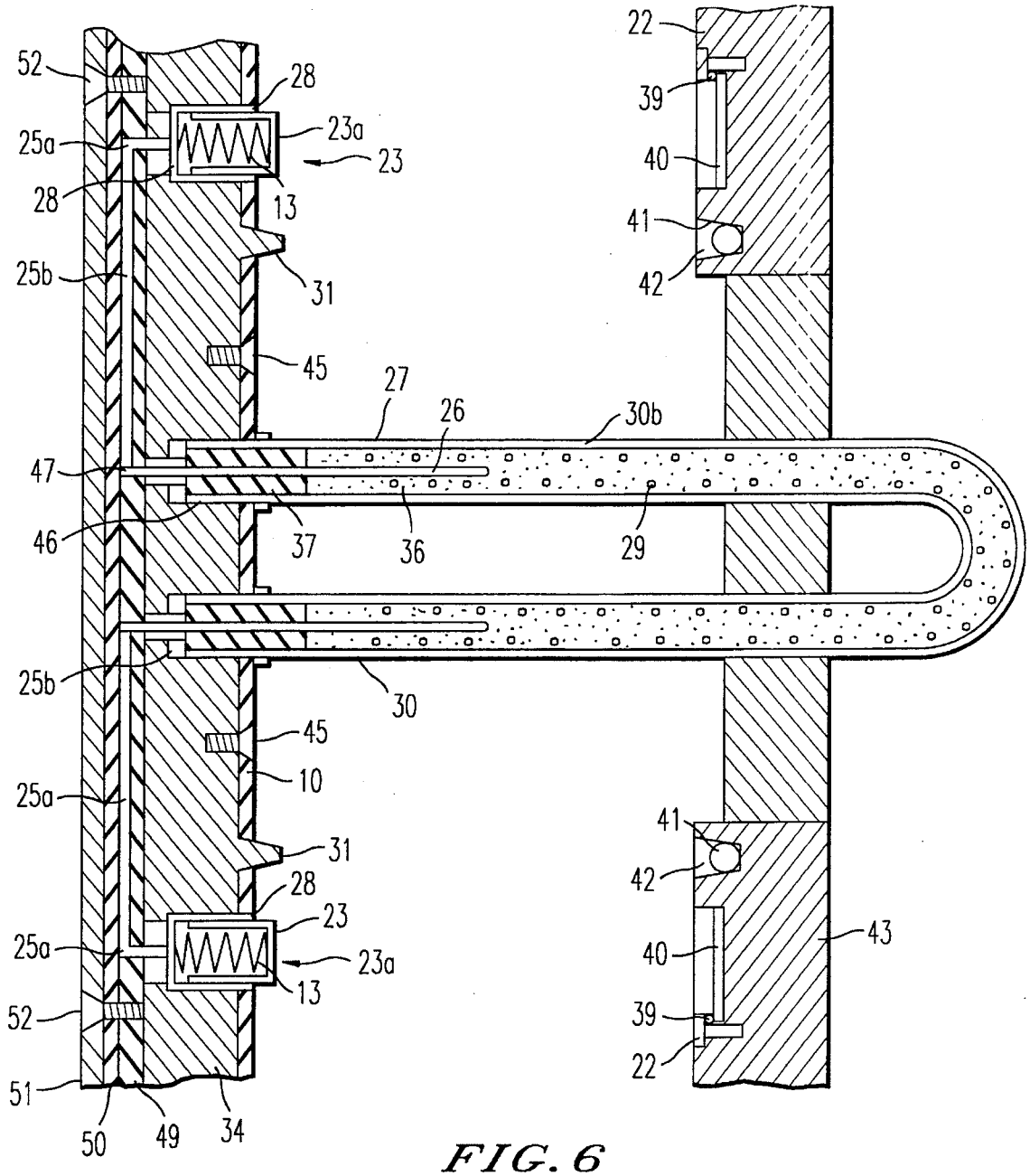
FIG. 6 shows a cross section view of the first plate and the second plate, the plates being aligned for mounting.

FIG. 6 shows the first plate 43 and the second plate 34 aligned such that the heating element extends through the center hole 70 of the first plate 43 and the ring-like protrusion 31 engages the cavity 42 and the caps 23*a* contact the power supply terminals 40. The second plate 34 is bolted to the first plate 43 with bolts 33 that extend through holes 35 and into a threaded hole 44 of the first plate 43.

The heating element 30 comprises an outer shell 30*b* having a resistor 29 within. The resistor 29 is held in place by compact refractory material 36. The electrical resistor 29 is connected to a terminal pin which contacts the interconnection lines 25*b*. The interconnection lines 25*b* contact the base plate 48 of the contact terminal 23. As clearly seen, the interconnection lines 25*b* are secured within the second plate 34.

Figure 7:
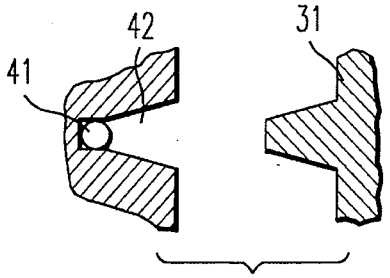
FIG. 7 is an enlarged view of the protrusion on the second plate which fits into the ring-like groove of the first plate.

FIG. 7 shows an enlarged view of the cavity 42 with a rubber gasket 41 for receiving a ring-like protrusion 31. As shown, the ring-like protrusion 31 is tightly fitted within the cavity 42 for sealing water within a hot water tank (not shown).

Figure 8:
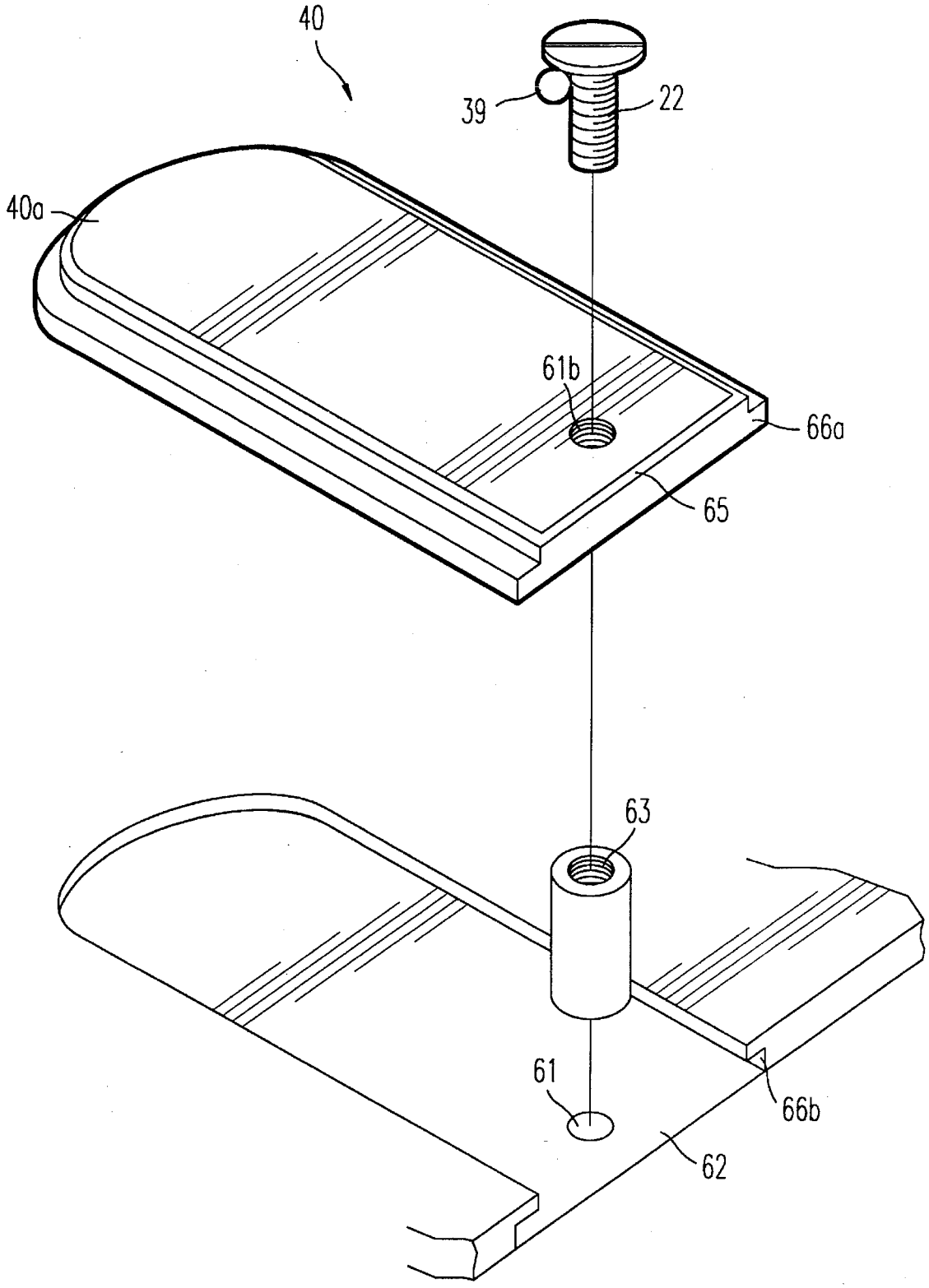
FIG. 8 is an enlarged, exploded view of the supply terminal, a sleeve and the first plate.

FIG. 8 shows an enlarged view of the electrical supply terminal 40. The terminal includes a groove 62 for receiving a copper contact plate 40*a* and copper screw 22. An electrical insulating sleeve 63 with inner threads is fitted within a hole 61 in the groove 62. The copper screw 22 fits within a hole 61*b* of the copper contact plate 40*a*. The copper screw 22 and copper contact plate 40 are connected to the groove 62, such that the wire 39 is in electrical contact with the copper contact plate 40*a*. A strip of outer electrical insulator 65 runs along the edge of the top side of the copper contact plate 40*a*. The copper contact plate 40*a* may be constructed with a larger base 66*a* which fits into a slot 66*b* of the groove, such that the copper contact plate 40 fits snugly within the groove 62.

Therefore, an immersion type water heating element apparatus is provided which allows easy replacement of the heating element without having to remove electrical supply wires 39 or disconnect an electrical supply. A repair person is now free to remove a water heating element using the present invention without risking the danger of electrical shock.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. An immersion type water heating element assembly comprising:

a first main plate having a hole therethrough and attachable to a hot water tank;

electrical supply terminals positioned on the first main plate and permanently wired to an electrical supply for supplying electric current;

a second main plate detachably mounted to the first main plate;

contact terminals positioned on the second main plate which contact the electrical supply terminals when the second main plate is mounted on the first main plate;

sealing means associated with the first main plate and the second main plate for preventing water in the hot water tank from leaking through the first main plate and the second main plate;

an immersion type heating element attached to the second main plate such that, when the second main plate is mounted on the first main plate and the first main plate is attached to a hot water tank, the heating element extends into the hot water tank through the hole in the first main plate, wherein when the second main plate with the heating element is removed from the first main plate the electrical supply does not have to be disconnected from the electrical supply terminals;

conducting means associated with the second main plate for electrically connecting the contact terminals to the heating element; and an electrical resistor contained within the immersion type heating element and connected to the power contact terminals such that, when the second main plate is mounted on the first main plate, electric current flows from the electrical supply terminals to the contact terminals and through the conducting means to the electrical resistor, thereby heating the water in the hot water tank.

2. An immersion type water heating element assembly according to claim 1, wherein each of the contact terminals comprise:

a cap which is electrically conductive;

a spring loaded into the cap which is electrically conductive for forcing the cap against the supply terminals on the first main plate; and a base plate positioned within the second main plate for holding the spring against the cap and in contact with the conducting means for conducting electricity from the cap, through the spring and to the electrical resistor.

3. An immersion type water heating element assembly according to claim 1, wherein each of the supply terminals comprise:

a conducting plate for engaging the spring loaded cap thereby completing the electrical path from the electrical supply to the second main plate;

an electrically conductive screw for holding the conducting plate to the first main plate; and an electrical insulator between the conducting plate and the first main plate.

4. An immersion type water heating element assembly according to claim 3, further comprising:

an electrically insulated sleeve having inner threads and submerged within the first main plate for receiving the electrically conductive screw and for ensuring that the first main plate does not electrically contact the conducting plate.

5. An immersion type water heating element assembly according to claim 1, wherein the sealing means comprises:

a ring-like protrusion on the second main plate which encircles the heating element;

a ring-like rubber gasket embedded in a cavity which encircles the hole in the first main plate, for receiving the protrusion when the second main plate is mounted on the first main plate, thereby sealing the second main plate and the first main plate.

6. An immersion type water heating element assembly according to claim 1, wherein the second main plate further comprises:

a heating element holding plate positioned on a face of the second main plate which meets the first main plate for holding the heating element in place;

a water sealing layer between the holding plate and second main plate.

7. An immersion type water heating element assembly according to claim 1, wherein the second main plate further comprises:

a first sealing plate positioned on a face of the second main plate opposite a face which engages the first main plate and having contact holes therethrough which access the contact terminals;

a second sealing plate positioned on the first sealing plate;

wherein the conducting means is tightly sandwiched between the first and second sealing plates which connect the contact terminals through the contact holes to the electrical resistor;

an outer metal plate positioned on the second sealing plate for tightly pressing the first and second sealing plates to the second main plate;

wherein the first sealing plate, the second sealing plate, the conducting means and the outer metal plate are embedded within the face of the second main plate such that the outer metal plate is flush with the second main plate.

8. An immersion type water heating element assembly according to claim 1, wherein the heating element further comprises:

an outer heat conducting shell for containing the electrical resistor;

a terminal pin for engaging the conducting means and for transferring electricity to the resistor;

a sleeve for holding the terminal pin along the longitudinal axis of the shell; and compact refractory material placed around the terminal pin and resistor for holding the terminal pin and the resistor in place and for providing strength to the heating element.

9. An immersion type water heating element apparatus according to claim 1, wherein:

the electrical supply charges the resistor at 110 Volts.

10. An immersion type water heating element apparatus comprising:

first plate means mounted on a hot water tank for wiring supply terminals from an electrical supply to said first plate means;

heating element means for heating water in the hot water tank; and second plate means for holding the heating element means through the first plate means and inside the hot water tank, the second plate means being removably mountable on the first plate means and having contact terminals for engaging the supply terminals when the second plate means engages the first plate means and for allowing an operator to remove the heating element means from the hot water tank by removing the second plate means from the first plate means without disconnecting the wiring of the electrical supply.

11. An immersion type water heating element apparatus according to claim 10 further comprising:

inner connection means entirely enclosed within the second plate means and electrically insulated from the exterior of the second plate means for connecting the contact terminals with the supply terminals such that electricity flows to the heating element means and an operator is not exposed to electric shock.

12. An immersion type water heating element apparatus according to claim 10 further comprising:

water sealing means associated with the first main plate and the second main plate for preventing water from leaking through the first and the second plate means.

13. An immersion type water heating element apparatus according to claim 12 wherein the water sealing means comprises:

a ring-like protrusion on the first plate means; and a ring-like cavity in the second plate means for receiving the ring-like protrusion and for sealing in water.

* * * * *